US007392899B2

(12) United States Patent
Pham

(10) Patent No.: US 7,392,899 B2
(45) Date of Patent: Jul. 1, 2008

(54) SLEEVE WITH PULL TAB FOR CIGARETTE PACK AND METHOD OF MAKING

(75) Inventor: Xuan M. Pham, Glen Allen, VA (US)

(73) Assignee: Philip Morris USA Inc., Richmond, VA (US)

( * ) Notice: Subject to any disclaimer, the term of this patent is extended or adjusted under 35 U.S.C. 154(b) by 355 days.

(21) Appl. No.: 11/019,583

(22) Filed: Dec. 22, 2004

(65) Prior Publication Data

US 2005/0155878 A1 Jul. 21, 2005

Related U.S. Application Data

(60) Provisional application No. 60/533,260, filed on Dec. 31, 2003.

(51) Int. Cl.
*B65D 85/10* (2006.01)
*B65D 5/38* (2006.01)
*B65B 19/02* (2006.01)

(52) U.S. Cl. ..... 206/264; 53/444; 206/267; 206/270; 229/125.125; 229/160.1

(58) Field of Classification Search ..... 206/264–275, 206/215, 449; 229/160.1, 87.05, 122, 125.125, 229/164.1, 164.2, 215, 449; 53/410, 444, 53/456

See application file for complete search history.

(56) References Cited

U.S. PATENT DOCUMENTS 1,875,196 A * 8/1932 Molins ..... 206/273
2,112,013 A * 3/1938 Chalmers ..... 206/264
2,357,842 A * 9/1944 Moore ..... 229/164.1
3,311,283 A * 3/1967 Shimada et al. ..... 229/160.1
3,977,520 A * 8/1976 Grimm ..... 206/270
4,049,117 A 9/1977 Grimm
4,240,548 A * 12/1980 Stio ..... 206/270
4,303,155 A * 12/1981 Focke et al. ..... 206/273
4,586,605 A * 5/1986 Newsome ..... 206/270
4,779,733 A 10/1988 Kilian
5,035,935 A 7/1991 Thomas et al.
5,250,134 A 10/1993 Thomas et al.
5,363,955 A 11/1994 Fleenor
5,604,016 A 2/1997 Allegre
5,779,048 A * 7/1998 Dunn ..... 229/125.125
5,794,770 A * 8/1998 Plomgren et al. ..... 206/215
6,036,006 A 3/2000 Focke
6,145,829 A 11/2000 Furmanski et al.
6,401,918 B1 6/2002 Focke et al.
6,427,423 B1 8/2002 Hinzman et al.
6,474,468 B1 * 11/2002 Griffith ..... 206/267

FOREIGN PATENT DOCUMENTS

EP 0 567 249 10/1993
GB 1448629 9/1976

* cited by examiner

*Primary Examiner*—Bryon P Gehman
(74) *Attorney, Agent, or Firm*—Connolly Bove Lodge & Hutz LLP

(57) ABSTRACT

A sleeve is wrapped around a package and enveloped within a film. The sleeve can be removed from the interior of the film and used independently of the package and film. The sleeve can include printed information for use by consumers such as product identifier information. The interior of the sleeve can be printed with information such as coupon or prize information.

11 Claims, 3 Drawing Sheets

SLEEVE WITH PULL TAB FOR CIGARETTE PACK AND METHOD OF MAKING

CROSS REFERENCE TO RELATED APPLICATION

The present application claims the benefit of provisional application Ser. No. 60/533,260, filed Dec. 31, 2003, in their entirety for all useful purposes.

BACKGROUND

1. Technical Field

The technical field is packages. More specifically, the technical field includes packages having additional surface areas for conveying information to consumers and other users.

2. Background Art

Film envelopment of packages, such as packages containing cigarettes and other tobacco products, is known. Cigarette packaging typically includes a paper or cardboard package enveloped in a film. In some applications, films may not have sufficient surface area or may not be sufficiently durable. Information printed on those films may therefore be lost or damaged when removed from the package.

SUMMARY

According to one embodiment, an article of manufacture comprises a sleeve wrapped around a package, and a film enveloping the sleeve and the package. The sleeve is removable from the interior of the film when a portion of the film is removed.

According to the above embodiment, information can be printed on the exterior and on the interior of the sleeve. Once removed from the film, a consumer, for example, has access to information on the interior of the sleeve. The information may be, for example, coupon information. The coupon information is secure within the film until the package is purchased and the film is opened. Further, the package is not damaged when the sleeve is removed, and may continue to be used normally.

Those skilled in the art will appreciate the above stated advantages and other advantages and benefits of various embodiments of the invention upon reading the following detailed description of the embodiments with reference to the below-listed drawings.

According to common practice, the various features of the drawings are not necessarily drawn to scale. Dimensions of various features may be expanded or reduced to more clearly illustrate the embodiments of the invention.

BRIEF DESCRIPTION OF THE DRAWINGS

The detailed description will refer to the following drawings, wherein like numerals refer to like elements, and wherein.

DETAILED DESCRIPTION

Figure 1:
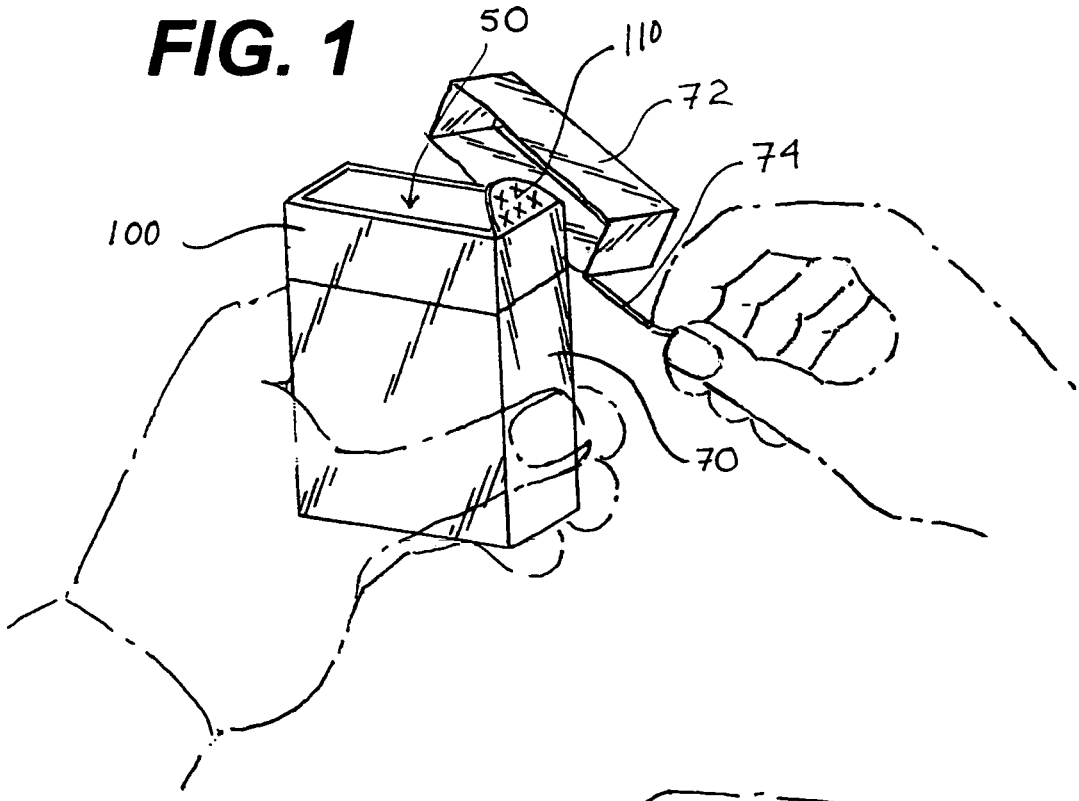
FIG. 1 is a perspective view of a sleeve arranged on a package according to an embodiment of the invention.
Figure 2:
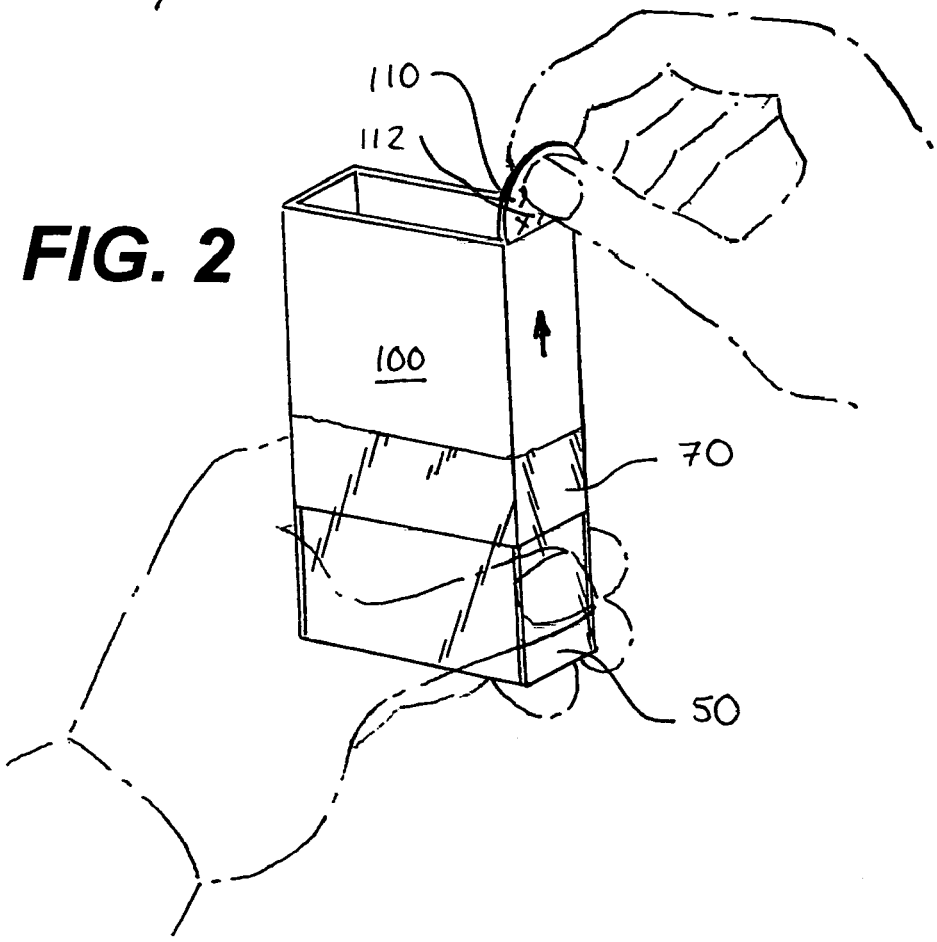
FIG. 2 is a perspective view of the sleeve illustrated in FIG. 1 being removed from a film enveloping the package.

FIG. 1 is a perspective view of a sleeve 100 according to an embodiment of the invention. The sleeve is arranged around a package 50, and enveloped within a film 70. In FIG. 1, a top 72 of the film is in the process of being removed by pulling a tear-tape 74 around the package 50. FIG. 2 is a perspective view of the sleeve 100 being removed from the inside of the film 70, after the top 72 has been removed.

The sleeve 100 may be made from materials such as, for example, soft paper or thin cardboard. The film 70 may be made from materials such as, for example, polypropylene, metalized polypropylene, and laminated polypropylene, as are known in the packaging art. Such films are known in their uses, for example, for enveloping cigarette packages and packages for other tobacco products.

The sleeve 100 is wrapped around the package 50, and is enveloped within the film 70 along with the package 50. The interior and the exterior of the sleeve 100 may be printed with, for example graphics and characters, and product information. For example, the exterior of the sleeve 100 can include product information that mimics or supplements product information printed on the package 50. The interior of the sleeve 100 can include, for example, product information such as coupon information, contest information, etc.

The sleeve 100 can include a pull-tab 110 to allow for easy removal of the sleeve 100 from the film 70. The pull-tab 110 can be bent over and may lie next to the package 50 when the film 70 envelops the package 50. The pull-tab 110 may have some resiliency and may extend outwardly from the package 50 when the top 72 of the film 70 is removed as shown in FIG. 1.

The pull-tab 110 can include an embossed pattern 112 (FIG. 2) to provide a sure grip of the pull-tab 110. The pull-tab 110 can also include written instructions or other indicia, Such as an arrow, to indicate to a person that the pull-tab 110 is to be pulled in a certain way in order to remove the sleeve 100 from the interior of the film 70. The interior of the sleeve 100 can have a relatively smooth surface to allow ease of removal from the film 70. The exterior of the sleeve 100 can have a glossy paper surface, for example, to provide a more attractive appearance.

The sleeve 100 may extend along all or along a part of the height of the package 50. The height of the sleeve 100 may depend upon, for example, the amount of information that is to be printed on the sleeve 100. For example, as shown in FIGS. 1 and 2, the sleeve 100 substantially corresponds in height with the package 50. Smaller sleeves, however, may be used, such as sleeves that have a height that is at least about ¼, ½, or ¾ of the height of the package 50. In such cases, a pull tab for the shorter sleeves should extend beyond the film 70 so that a user can remove the sleeve from the film 70 when the top 72 is removed.

FIGS. 3-8 illustrate a method of manufacturing the sleeve 100 and applying the sleeve to the package 50. The method is discussed in detail below.

Figure 3:
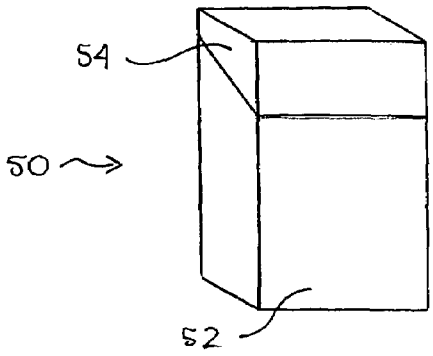
FIGS. 3-8 illustrate stages of manufacture of the sleeve illustrated in FIGS. 1 and 2 and application of the sleeve and a film to the package.

Referring to FIG. 3, a package 50 is provided having a base portion 52 and a lid 54. The lid 54 is pivotably attached to the base portion 52. The package 50 can be of a known type, such as those packages used as packaging for cigarettes and other tobacco products, for example.

Figure 4:
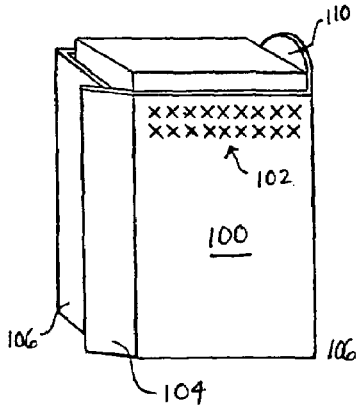

In FIG. 4, the sleeve 100 is provided. The sleeve 100 can be formed from a sheet of soft paper or thin cardboard. The sleeve 100 may have information printed on both the interior (the portion facing the package 50) and the exterior of the sleeve 100. The sleeve 100 may form a tubular shape when wrapped around the package 50, and may closely conform to the package 50. Closely conforming the sleeve 100 to the package 50 minimizes the increase in size of the wrapped package 50. The package 50 may therefore be dispensed through conventional vending machines.

The sleeve 100 may include opposed flaps 104, 106 that overlap when the sleeve is wrapped around the package 50. The sleeve 100 also includes the pull tab 110 for removing the sleeve from the film 70. The sleeve 100 may include the embossed portion 112 (FIG. 2) located on the pull tab 11.0, and embossed patterns 102 may also be included on sides of the sleeve 100.

Figure 9:
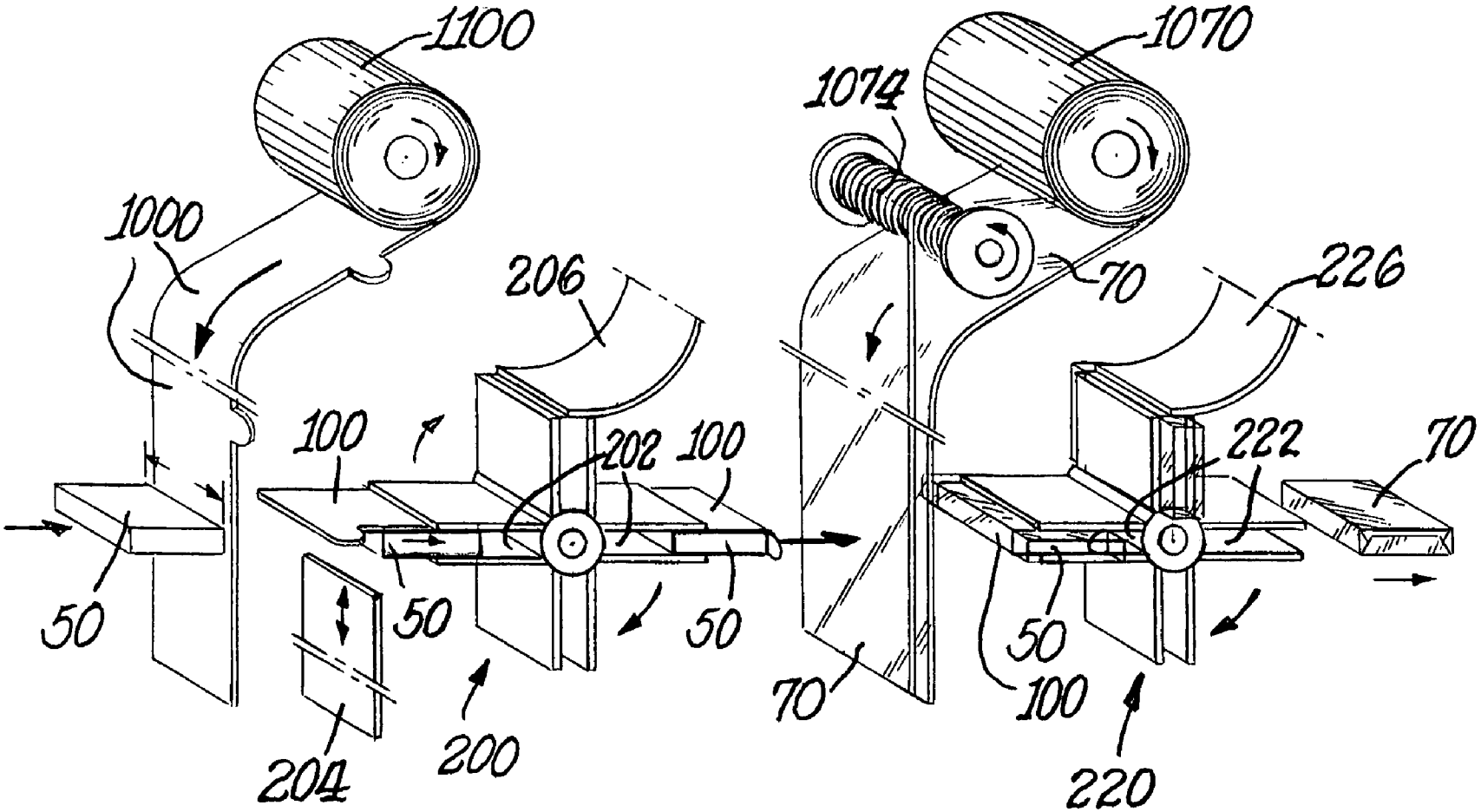
FIG. 9 illustrates an embodiment of a machine for wrapping sleeves around packages and for enveloping packages in film.

The sleeve 100 may be applied in an automated process. An exemplary embodiment of an apparatus and method for applying the sleeve 100 and the film 70 is illustrated in FIG. 9.

Figure 5:
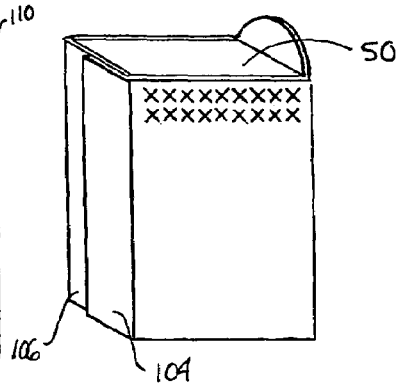

Referring to FIG. 5, the overlapping flaps 104, 106 of the sleeve 100 are joined together at the overlapping portion. The flaps 104, 106 can be joined, for example, by a light tack seal such as glue dots applied to the overlapping flaps 104, 106. A light tack seal allows the flaps 104, 106 to be separated after removal of the sleeve 100 from the interior of the film 70.

Figure 6:
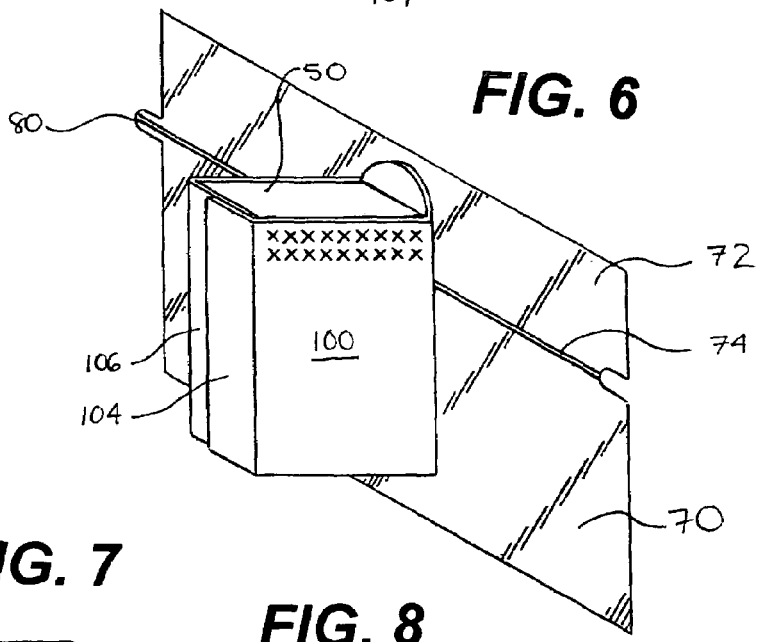

Referring to FIG. 6, a film 70 is wrapped around the package 50 and the sleeve 100. To apply the film 70, a roll of stock film material may be fed into an over-wrapping machine. Stock material (not shown) may also be provided, for example, in pre-cut form. The stock film is separated into individual films 70 formed from the stock film material. A large number of packages 50 and accompanying sleeves 100 can be enveloped in individual films 70.

The film 70 includes a top portion 72 and a tear-tape 74 extending along a length of the film 70. The tear-tape 74 may be of a type known in the art. The tear-tape 74 may be applied, for example, by applying pressure to force the stock film material together with strips of tear-tape material. The film 70 may include a protrusion tab 80 at one end of the film 70 to facilitate pulling of the tear-tape 74.

Figure 7:
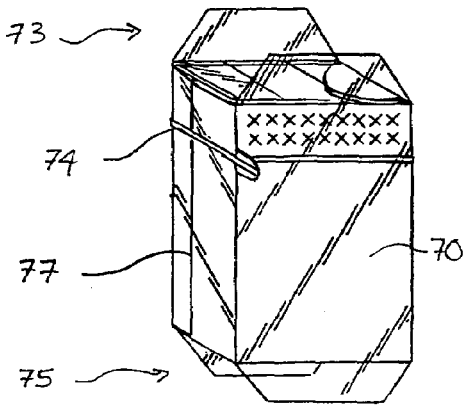

Referring to FIG. 7, the film 70 is wrapped around the package 50. The film 70 may be sealed along the side of the package 50 at a side seam 77. The side seam 77 may be formed by, for example, application of heat.

Figure 8:
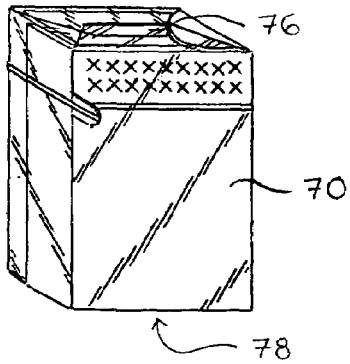

Referring to FIG. 8, excess material 73, 75 at the ends of the seal 70 is then folded and sealed, forming a top seal 76 and a bottom seal 78. The top and bottom seals 76, 78 may be formed by application of heat. After formation of the seals 76, 78, the package 50 is enveloped, along with the sleeve 100, in the film 70.

FIG. 9 illustrates an embodiment of an apparatus 2000 for enveloping packages 50. In FIG. 9, packages 50 are supplied from the left side of the figure. The packages 50 supplied to the apparatus 2000 contain a product, such as tobacco products. A bobbin of stock sleeve material 1100 is unrolled to provide individual sleeves 100 to wrap around the packages 50. The bobbin of stock sleeve material 1100 may include a large number of individual sleeve sections 100.

Individual sleeves 100 are separated from the sleeve material 1100 as packages 50 are fed into a first turret 200. The turret 200 includes pockets 202 for receiving packages 50. The sleeve material 1100 can be cut into sleeves 100 by, for example, a cutting roller. After a package 50 is placed into a pocket 202, a tucking plate 204 closes one of the flaps of the sleeve 100 that is wrapped around the package 50.

The turret 200 then rotates 90 degrees in the direction shown by the arrows adjacent the first turret 200. As the turret 200 rotates, the second flap of the sleeve 100 is tucked by a tucking and sealing plate 206. An adhesive may be used to seal the flaps of the sleeve 100 together, under the action of the tucking and sealing plate 206.

The turret 200 rotates 90 degrees further and the package 50 and sleeve 100 are engaged with an individual film 70. A large number of individual film sections 70 can be supplied on a roll or bobbin of stock film material 1070. A roll or bobbin of tear-tape strip material 1074 can also be mounted near the bobbin of stock film material 1070. The tear-tape strip material 1074 is used to form the individual tear-tapes 74 (FIG. 6). The tear-tape material 1074 and the stock film material 1070 may be pressed together by spaced rollers (not shown) to join the tear-tape material 1074 to the stock film material 1070. The stock film material 1070 and the tear-tape material 1074 can be cut by, for example, a cutting roller.

The package 50 and sleeve 100 are pressed into a pocket 222 of a second turret 220. A tucking and sealing plate 226 seals the sides of the film 70. The top and bottom of the film sections 70 can also be sealed in a conventional manner.

The over-wrapping function used to seal individual film sections 70 around the packages 50 and sleeves 100 may be of a type known in the packaging industry. For example, an over-wrapping machine manufactured by G.D. Package Machinery, Inc., or Focke and Co. can be used to practice the overwrapping methods described in this specification.

Stock sleeve material to form the sleeves 100 may alternatively be provided in the form of individual sleeves 100, rather than as a bobbin of stock material 1100. In this embodiment, cut sleeves 100 are provided in a hopper and delivered to the machine 2000 for wrapping around packages 50.

Stock film material may also be provided in the form of individual sheets of films 70, rather than as a bobbin of stock material 1070. In this method, cut sheets of films 70 are provided in a hopper and delivered to the overwrapping machine for enveloping around packages 50. Each individual film 70 in the hopper may have a tear-tape 74 applied as shown in FIG. 6.

According to the above embodiments, the sleeve 100 provides a vehicle for information that can be used independent of the package 50. The sleeve 100 may be printed with any form of information, on both the interior and the exterior of the sleeve 100. The information on the sleeve 100 can mimic and supplement information on the exterior of the package 50.

The interior of the sleeve 100 can include a relatively smooth surface so that excessive friction between the sleeve 100 and the package 50 does not make removal of the sleeve 100 difficult.

If coupon information is printed on the sleeve 100, the coupon information is secure because the film 70 must be removed before persons have access to the coupon. This feature protects the value of redeemable coupons.

A portion of the sleeve 100 may be cut away so that an export stamp on the package 50 may be visible. If the film 70 includes printed information, a portion of the film 70 may be clear in order to allow the export stamp to be seen from the exterior of the film 70. The sleeve 100 therefore does not interfere with a view of the export stamp.

Conventional over-wrap shrink film processes can be used to envelop the package 50 and the sleeve 100 within the film 70. Further, vending machines for distributing packages do not require alteration in order to accommodate the sleeve 100.

The foregoing description of the invention illustrates and describes the present invention. Additionally, the disclosure shows and describes only the preferred embodiments of the invention, but it is to be understood that the invention is capable of use in various other combinations, modifications, and environments and is capable of changes or modifications within the scope of the inventive concept as expressed herein, commensurate with the above teachings, and/or the skill or knowledge of the relevant art.

The embodiments described hereinabove are further intended to explain best modes known of practicing the invention and to enable others skilled in the art to utilize the invention in such, or other, embodiments and with the various modifications required by the particular applications or uses of the invention. Accordingly, the description is not intended to limit the invention to the form disclosed herein. Also, it is intended that the appended claims be construed to include alternative embodiments.

What is claimed is:

1. An article of manufacture, comprising:

a cigarette pack comprising a base portion and a lid;

a completely removable sleeve wrapped around the cigarette pack but otherwise unattached to the cigarette pack, the removable sleeve including opposed flaps that overlap at a side of the cigarette pack and a pull tab extending from an upper edge of the sleeve and a film enveloping the sleeve and cigarette pack, the pull tab for pulling the sleeve away from the cigarette pack when the film enveloping the sleeve and cigarette pack is opened.

2. The article of claim 1, wherein the pull tab is folded over the cigarette pack adjacent to the lid.

3. The article of claim 1, wherein the sleeve has a height of at least ¼a height of the cigarette pack.

4. The article of claim 1, wherein the pull tab has an embossed pattern to provide a sure grip of the pull tab upon removal of the sleeve from the cigarette pack.

5. The article of claim 1, wherein the opposed flaps of the sleeve are releasably secured together with adhesive.

6. A method, comprising:

providing a cigarette pack having a base portion and a lid;

providing a sleeve;

wrapping the sleeve around the pack so that the sleeve is not otherwise attached to the cigarette, the sleeve including opposed flaps that overlap at a side of the cigarette pack and a pull tab extending from an upper edge of the sleeve for pulling the sleeve away from the cigarette pack when film enveloping the sleeve and cigarette pack is opened;

providing a film; and enveloping the cigarette pack and the sleeve in the film.

7. The method of claim 6, wherein providing the sleeve comprises:

providing a pull tab extending from an edge of the sleeve.

8. The method of claim 6, wherein providing a film comprises:

unrolling sections of film from a bobbin of stock film material.

9. The method of claim 6, wherein providing a sleeve comprises:

unrolling sections of sleeve from a bobbin of stock sleeve material.

10. The method of claim 6, wherein providing a film comprises:

providing a hopper of individual films.

11. The method of claim 6, wherein providing a sleeve comprises:

providing a hopper of individual sleeves.

* * * * *